US011710911B2

(12) United States Patent
Takeuchi et al.

(10) Patent No.: US 11,710,911 B2
(45) Date of Patent: Jul. 25, 2023

(54) TERMINAL WITH A WIRE CONNECTING PORTION HAVING A SANDWICHING PORTION

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Shunya Takeuchi, Mie (JP); Masaaki Tabata, Mie (JP); Nungna Wi, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 107 days.

(21) Appl. No.: 17/601,566

(22) PCT Filed: Apr. 2, 2020

(86) PCT No.: PCT/JP2020/015215
§ 371 (c)(1),
(2) Date: Oct. 5, 2021

(87) PCT Pub. No.: WO2020/209178
PCT Pub. Date: Oct. 15, 2020

(65) Prior Publication Data

US 2022/0209434 A1 Jun. 30, 2022

(30) Foreign Application Priority Data

Apr. 10, 2019 (JP) ..... 2019-074920

(51) Int. Cl.
*H01R 4/28* (2006.01)

(52) U.S. Cl.
CPC ..... *H01R 4/28* (2013.01)

(58) Field of Classification Search
CPC ..... H01R 4/28; H01R 13/04; H01R 13/02; H01R 13/10; H01R 13/11
See application file for complete search history.

(56) References Cited

U.S. PATENT DOCUMENTS 5,112,244 A * 5/1992 Kuzuno ..... H01R 4/2454 439/395
5,399,097 A * 3/1995 Sakai ..... H01R 4/2466 439/417

(Continued)

FOREIGN PATENT DOCUMENTS

JP 2015-056209 A 3/2015

OTHER PUBLICATIONS

International Search Report dated Jun. 23, 2020 for WO 2020/209178 A1 (4 pages).

*Primary Examiner* — Harshad C Patel
(74) *Attorney, Agent, or Firm* — Venjuris, P.C.

(57) ABSTRACT

A terminal is provided with a terminal body including a mating connecting portion, a wire connecting portion and a coupling portion, and a shell. The wire connecting portion includes sandwiching portions extending in an extending direction of a wire and configured to sandwich the wire. The shell includes pressurizing portions for pressurizing the sandwiching portions toward the wire. The mating connecting portion includes a mating bottom wall and mating side walls formed to rise upward in a predetermined rising direction from the mating bottom wall. The wire connecting portion includes a wire-side bottom wall and wire-side side walls rising upward in the rising direction from the wire-side bottom wall. The coupling portion is inclined in a direction (Continued)

opposite to the rising direction from the wire-side bottom wall toward the mating bottom wall to couple the wire-side bottom wall and the mating bottom wall.

6 Claims, 7 Drawing Sheets

(56) References Cited

U.S. PATENT DOCUMENTS

| | | | | |
|---|---|---|---|---|
| 5,924,887 | A * | 7/1999 | Aoyama | H01R 4/2466 439/400 |
| 6,729,895 | B1 | 5/2004 | Bryan | |
| 7,306,495 | B2 | 12/2007 | Hashimoto et al. | |
| 10,505,290 | B2 * | 12/2019 | Kuroiwa | H01R 4/28 |
| 11,152,718 | B2 * | 10/2021 | Miyamura | H01R 4/5083 |
| 2004/0242068 | A1 | 12/2004 | Fukuda et al. | |
| 2015/0325929 | A1 * | 11/2015 | Okura | H01R 4/26 439/444 |
| 2020/0266556 | A1 * | 8/2020 | Takeuchi | H01R 13/10 |
| 2022/0231434 | A1 * | 7/2022 | Takeuchi | H01R 4/50 |

* cited by examiner

TERMINAL WITH A WIRE CONNECTING PORTION HAVING A SANDWICHING PORTION

CROSS REFERENCE TO RELATED APPLICATIONS

This application is a national phase of PCT application No. PCT/JP2020/015215, filed on 2 Apr. 2020, which claims priority from Japanese patent application No. 2019-074920, filed on 10 Apr. 2019, all of which are incorporated herein by reference.

TECHNICAL FIELD

The present disclosure relates to a terminal and a wire with terminal.

BACKGROUND

Conventionally, a wire with terminal is known in which a terminal is connected to a core exposed from an end of a wire. Some of such terminals include, for example, a crimping portion to be crimped to the core exposed from the end of the wire from outside.

The above terminal is crimped to the wire, for example, as follows. First, the terminal of a predetermined shape is formed by press-working a metal plate material. Subsequently, the terminal is placed on a placing portion of a lower die located on a lower side, out of a pair of dies relatively movable in a vertical direction. Subsequently, the core exposed from the end of the wire is placed on the crimping portion of the terminal. Thereafter, one or both of the pair of dies is/are moved in mutually approaching direction(s), and the crimping portion is sandwiched between a crimper of the upper die and the placing portion of the lower die, whereby the crimping portion is crimped to the core of the wire. In the above way, the terminal is connected to the end of the wire (see Patent Document 1).

PRIOR ART DOCUMENT

Patent Document

Patent Document 1: JP 2005-050736 A

SUMMARY OF THE INVENTION

Problems to be Solved

In the case of connection by sandwiching a core instead of using the above crimping portion, a terminal is possibly constituted by two components including a terminal body and a slide portion disposed behind the terminal body. In this case, if a step is formed between the two components, there is a problem that the terminal rattles when being disposed in a connector.

The present disclosure was completed on the basis of the above situation and aims to provide a terminal with a reduced step.

Means to Solve the Problem

The present disclosure is directed to a terminal with a terminal body including a mating connecting portion to be connected to a mating terminal, a wire connecting portion to be connected to a wire and a coupling portion for coupling the mating connecting portion and the wire connecting portion, and a shell to be externally fit to the wire connecting portion, wherein the wire connecting portion includes a sandwiching portion extending in an extending direction of the wire, the sandwiching portion sandwiching the wire, the shell includes a pressurizing portion for pressurizing the sandwiching portion toward the wire, the mating connecting portion includes a mating bottom wall and a mating side wall formed to rise upward in a predetermined rising direction from the mating bottom wall, the wire connecting portion includes a wire-side bottom wall and a wire-side side wall rising upward in the rising direction from the wire-side bottom wall, and the coupling portion is inclined in a direction opposite to the rising direction from the wire-side bottom wall toward the mating bottom wall to couple the wire-side bottom wall and the mating bottom wall.

Effect of the Invention

According to the present disclosure, it is possible to provide a terminal with a reduced step.

DETAILED DESCRIPTION TO EXECUTE THE INVENTION

[Description of Embodiments of Present Disclosure]

Figure 1:
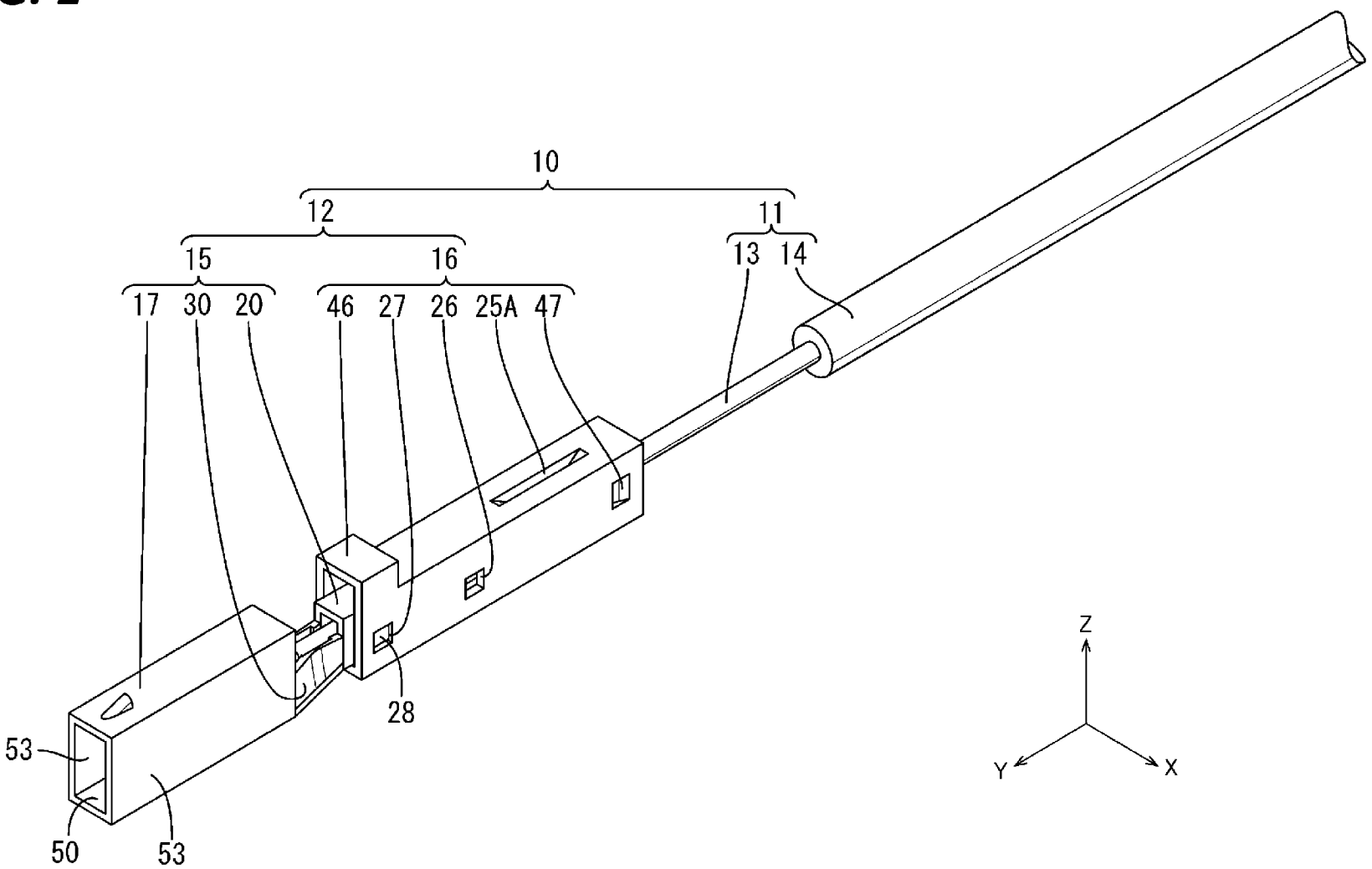
FIG. 1 is a perspective view showing a wire with terminal according to an embodiment.

First, embodiments of the present disclosure are listed and described.

(1) The terminal according to the present disclosure is provided with a terminal body including a mating connecting portion to be connected to a mating terminal, a wire connecting portion to be connected to a wire and a coupling portion for coupling the mating connecting portion and the wire connecting portion, and a shell to be externally fit to the wire connecting portion, wherein the wire connecting portion includes a sandwiching portion extending in an extending direction of the wire, the sandwiching portion sandwiching the wire, the shell includes a pressurizing portion for pressurizing the sandwiching portion toward the wire, the mating connecting portion includes a mating bottom wall and a mating side wall formed to rise upward in a predetermined rising direction from the mating bottom wall, the wire connecting portion includes a wire-side bottom wall and a wire-side side wall rising upward in the rising direction from the wire-side bottom wall, and the coupling portion is inclined in a direction opposite to the rising direction from the wire-side bottom wall toward the mating bottom wall to couple the wire-side bottom wall and the mating bottom wall.

Since the shell is externally fit to the wire connecting portion, the shell covers the wire-side bottom wall of the wire connecting portion. Thus, the shell projects more outward than the wire-side bottom wall. However, the mating bottom wall of the mating connecting portion coupled to the wire-side bottom wall by the coupling portion projects more outward than the wire-side bottom wall since the coupling portion is inclined. Since both the bottom wall of the shell and the mating bottom wall project more outward than the wire-side bottom wall, a step of the terminal can be reduced as compared to the shape of the terminal in which only the bottom wall of the shell projects outward.

(2) Preferably, the coupling portion includes a coupling bottom wall coupling the mating bottom wall and the wire-side bottom wall and a pair of coupling side walls rising upward from the coupling bottom wall, and the pair of coupling side walls respectively include constricted portions bent in directions toward each other.

If the coupling bottom wall of the coupling portion is inclined, the pair of coupling side walls are also bent. At this time, by providing the pair of coupling side walls respectively with the constricted portions bent in the directions toward each other, the terminal can be reduced in size as compared to the case where the pair of coupling side walls are bent in directions away from each other.

(3) Preferably, a recess is provided in each of inner surfaces of the constricted portions provided in the pair of coupling side walls.

To reliably connect the wire and the wire connecting portion, the wire inserted through the wire connecting portion is preferably inserted into the coupling portion beyond the wire connecting portion. Since the recesses are formed in the inner surfaces of the pair of coupling side walls of the coupling portion, the interference of the inner surfaces of the pair of coupling side walls and the wire can be suppressed. As a result, when the wire is inserted into the terminal, the buckling of the wire can be suppressed.

(4) Preferably, a bottom surface of the shell and a bottom surface of the mating connecting portion are disposed on the same plane.

Since the bottom surface of the shell and that of the mating connecting portion are disposed on the same plane, an outer surface of the mating connecting portion and that of the shell can be placed on a plane formed to place the terminal in a connector without being inclined when the terminal is accommodated into the connector. In this way, troubles such as the rattling of the terminal in the connector can be reliably suppressed.

(5) Preferably, the shell is disposed slidably along the extending direction of the wire with respect to the wire connecting portion.

The wire and the terminal can be electrically connected by a simple operation of sliding the shell along the extending direction of the wire. In this way, the efficiency of a connecting operation of the wire and the terminal can be improved.

(6) A wire with terminal according to the present disclosure includes the terminal of any one of (1) to (5) described above, and a wire connected to the terminal.

[Details of Embodiment of Present Disclosure]

Hereinafter, an embodiment of the present disclosure is described. The present invention is not limited to these illustrations and is intended to be represented by claims and include all changes in the scope of claims and in the meaning and scope of equivalents.

<Embodiment>

One embodiment of the present disclosure is described with reference to FIGS. 1 to 8. A wire with terminal 10 according to this embodiment includes a wire 11 and a terminal 12 connected to the wire 11. The terminal 12 is connected to an unillustrated mating terminal. As shown in FIG. 1, the terminal 12 is connected to a front end part of the wire 11 in an extending direction (direction indicted by an arrow Y). In the following description, a direction indicated by an arrow Z is an upward direction, the direction indicated by the arrow Y is a forward direction and a direction indicated by an arrow X is a leftward direction. Note that, for a plurality of identical members, only some may be denoted by a reference sign and the others may not be denoted by the reference sign.

[Wire 11]

As shown in FIG. 1, the wire 11 is disposed to extend in the front-rear direction (an example of the extending direction). In the wire 11, the outer periphery of a core 13 is surrounded with an insulation coating 14 made of insulating synthetic resin. The core 13 according to this embodiment is composed of one metal wire. Note that the core 13 may be a stranded wire formed by twisting a plurality of metal thin wires. An arbitrary metal such as copper, copper alloy, aluminum or aluminum alloy can be appropriately selected as a metal constituting the core 13 if necessary. The core 13 according to this embodiment is made of copper or copper alloy.

[Terminal 12]

As shown in FIG. 1, the terminal 12 includes a terminal body 15 made of metal and a slide portion 16 (an example of a shell) relatively slidable with respect to the terminal body 15.

[Terminal Body 15]

Figure 2:
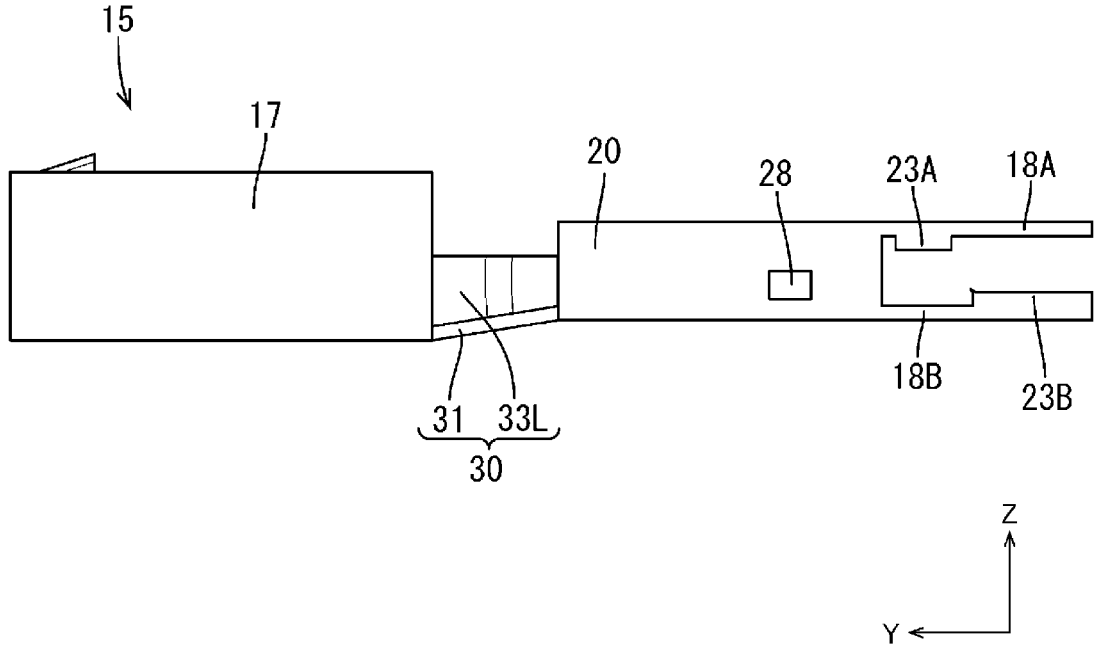
FIG. 2 is a side view showing a terminal body.

As shown in FIG. 2, the terminal body 15 is formed into a predetermined shape by a known method such as press-working, cutting or casting. An arbitrary metal such as copper, copper alloy, aluminum, aluminum alloy or stainless steel can be appropriately selected as a metal constituting the terminal body 15 if necessary. The terminal body 15 according to this embodiment is made of copper or copper alloy. A plating layer may be formed on the surface of the terminal body 15. An arbitrary metal such as tin, nickel or silver can be appropriately selected as a metal constituting the plating layer if necessary. Tin plating is applied to the terminal body 15 according to this embodiment.

As shown in FIG. 2, the terminal body 15 includes a tube portion 17 (an example of a mating connecting portion) into which a plate-like mating terminal is insertable, and a wire connecting portion 20 located behind the tube portion 17 and to be connected to the wire 11. The wire connecting portion 20 includes an upper sandwiching portion 18A and a lower sandwiching portion 18B extending rearward. The terminal 12 according to this embodiment is a so-called female terminal, and the mating terminal is a so-called male terminal.

Figure 3:
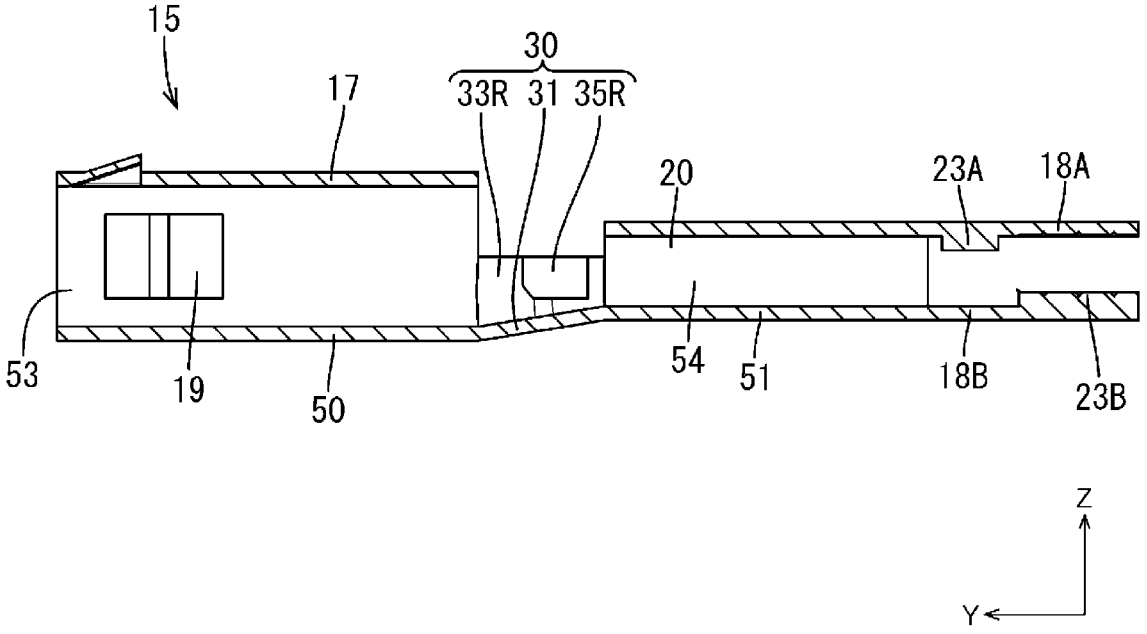
FIG. 3 is a section along in FIG. 4.

As shown in FIG. 3, the tube portion 17 is in the form of a rectangular tube extending in the front-rear direction. The tube portion 17 includes a mating bottom wall 50 and a pair of mating side walls 53 rising upward (an example of a predetermined rising direction) from side edges of the mating bottom wall 50. The front end of the tube portion 17 is open, so that the mating terminal is insertable. A resiliently deformable resilient contact piece 19 is disposed inside the tube portion 17. The resilient contact piece 19 extends inward from the inner wall of the tube portion 17. The mating terminal inserted into the tube portion 17 presses and resiliently deforms the resilient contact piece 19. By a resilient force of the resiliently deformed resilient contact piece 19, the mating terminal is sandwiched between the inner wall of the tube portion 17 and the resilient contact piece 19. In this way, the mating terminal and the terminal 12 are electrically connected.

As shown in FIGS. 2 and 3, the wire connecting portion 20 in the form of a rectangular tube is provided behind the tube portion 17. As shown in FIG. 3, the wire connecting portion 20 includes a wire-side bottom wall 51 and a pair of wire-side side walls 54 rising upward from side edges of the wire-side bottom wall 51. The upper sandwiching portion 18A (an example of a sandwiching portion) is provided to extend rearward in a rear end part of the upper wall of the wire connecting portion 20, and the lower sandwiching portion 18B (an example of the sandwiching portion) is provided to extend rearward in a rear end part of the wire-side bottom wall 51 of the wire connecting portion 20. The upper and lower sandwiching portions 18A, 18B have a shape elongated in the front-rear direction. Lengths in the front-rear direction of the upper and lower sandwiching portions 18A, 18B are substantially equal.

An upper holding protrusion 23A projecting downward is provided at a position in front of a rear end part on the lower surface of the upper sandwiching portion 18A. A lower holding protrusion 23B projecting upward is provided on a rear end part on the upper surface of the lower sandwiching portion 18B. The lower and upper holding protrusions 23B, 23A are provided at positions shifted in the front-rear direction.

The lower surface of the upper sandwiching portion 18A and the upper surface of the lower sandwiching portion 18B bite into an oxide film formed on the surface of the core 13 to peel off the oxide film, whereby a metal surface of the core 13 is exposed. By the contact of this metal surface and the upper and lower sandwiching portions 18A, 18B, the core 13 and the terminal body 15 are electrically connected.

Figure 4:
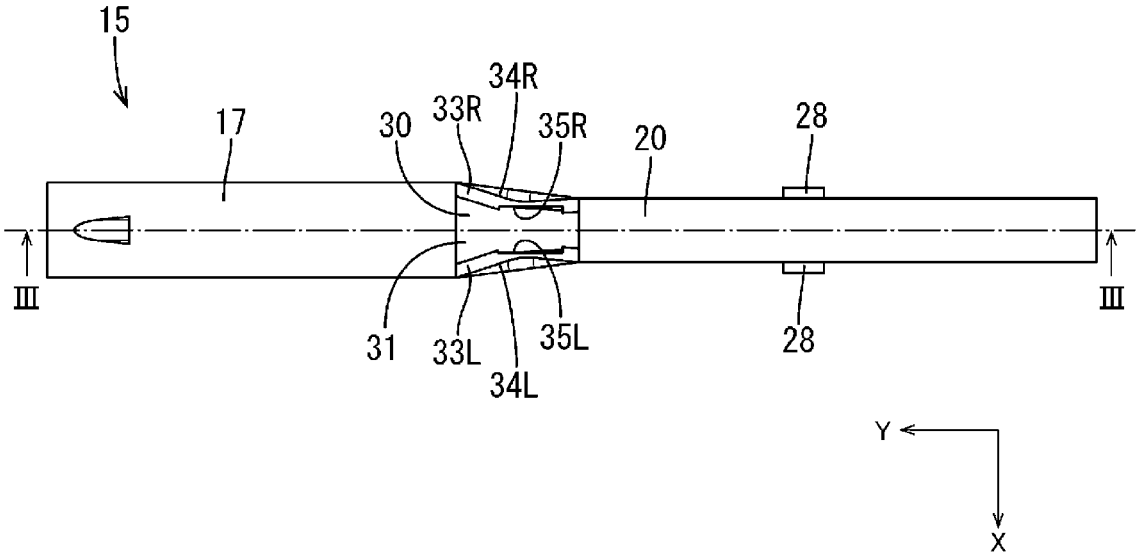
FIG. 4 is a plan view showing the terminal body.

As shown in FIG. 4, locking projections 28 projecting outward are formed on side walls of the terminal body 15. These locking projections 28 hold the slide portion 16 at a partial locking position and a full locking position by being locked to partial lock receiving portions 26 and full lock receiving portions 27 to be described later.

As shown in FIG. 4, the tube portion 17 and the wire connecting portion 20 are coupled by a coupling portion 30. The coupling portion 30 includes a coupling bottom wall 31 and a right side wall 33R and a left side wall 33L (an example of a pair of coupling side walls) extending upward from both left and right side edges of the coupling bottom wall 31.

As shown in FIG. 3, the coupling bottom wall 31 is coupled to the mating bottom wall 50 and the wire-side bottom wall 51. The mating bottom wall 50 is located to be lower than the wire-side bottom wall 51.

As shown in FIG. 3, the coupling bottom wall 31 is formed to be inclined downward from a rear side toward a front side. In other words, the coupling bottom wall 31 is inclined in a direction opposite to the rising direction of the wire-side side walls 54 from the wire-side bottom wall 51 toward the mating bottom wall 50.

As shown in FIG. 4, the right side wall 33R is concavely curved leftward near a center in the front-rear direction. Further, the left side wall 33L is concavely curved rightward near a center in the front-rear direction. In this way, the right and left side walls 33R, 33L respectively include a right constricted portion 34R (an example of a constricted portion) and a left constricted portion 34L (an example of the constricted portion) bent in directions toward each other.

As shown in FIG. 4, a right recess 35R is formed to be recessed rightward in the inner surface of the right constricted portion 34R. As shown in FIG. 3, the right recess 35R is formed from a position somewhat rearward of a front end part of the right side wall 33R to a position somewhat forward of a rear end part of the right side wall 33R. Further, the right recess 35R is formed from an upper end part of the right side wall 33R to a position somewhat upward of the coupling bottom wall 31 in the vertical direction.

As shown in FIG. 4, a left recess 35L formed in the left side wall 33L is formed bilaterally symmetrically with the right recess 35R.

Figure 5:
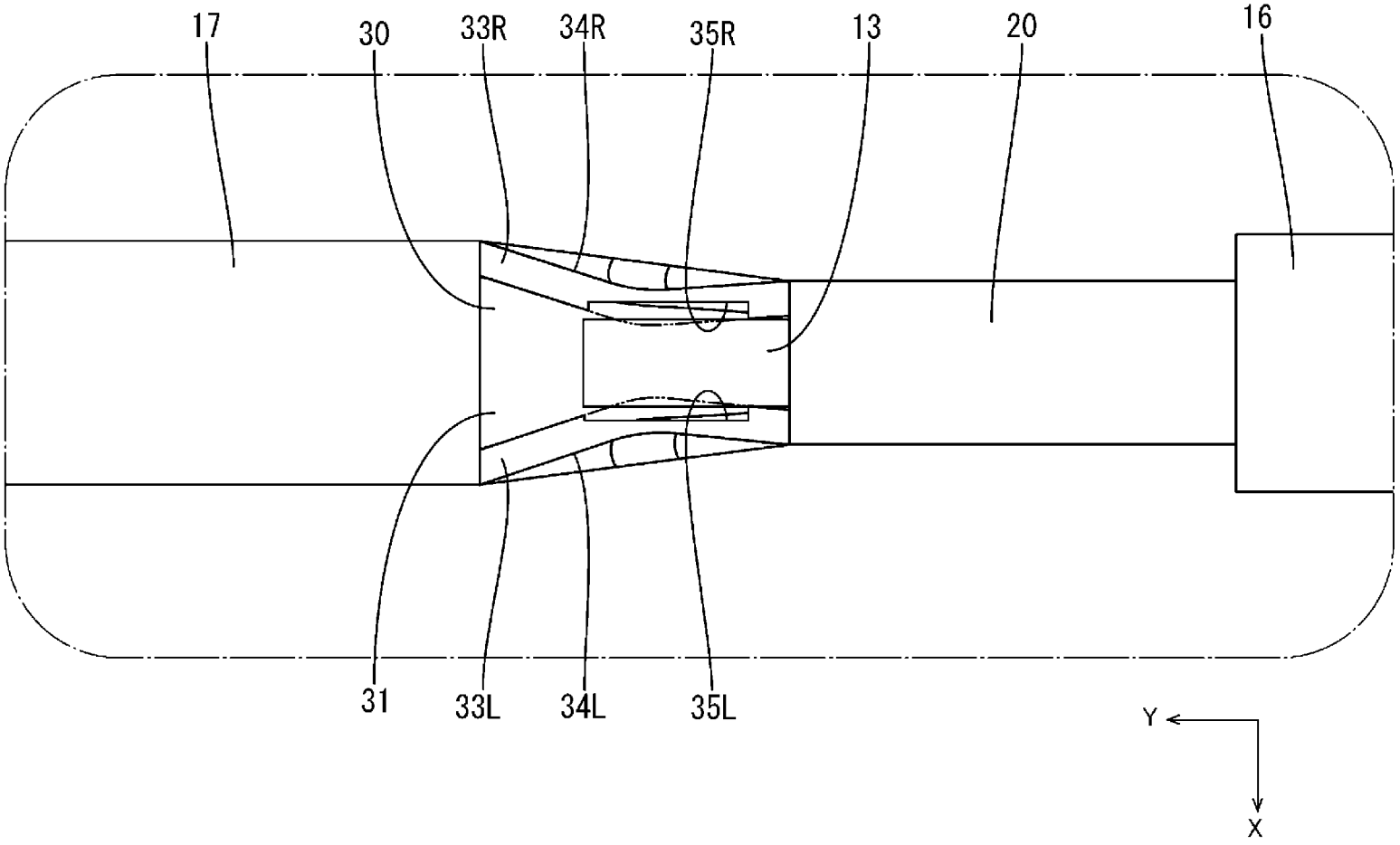
FIG. 5 is a partial enlarged plan view showing a state where a core is inserted in a coupling portion.

As shown in FIG. 5, an interval in the lateral direction between the right and left recesses 35R, 35L is set to be equal to or larger than a diameter of the core 13. In this way, the core 13 is insertable between the right and left side walls 33R, 33L from a rear side toward a front side.

[Slide Portion 16]

Figure 6:
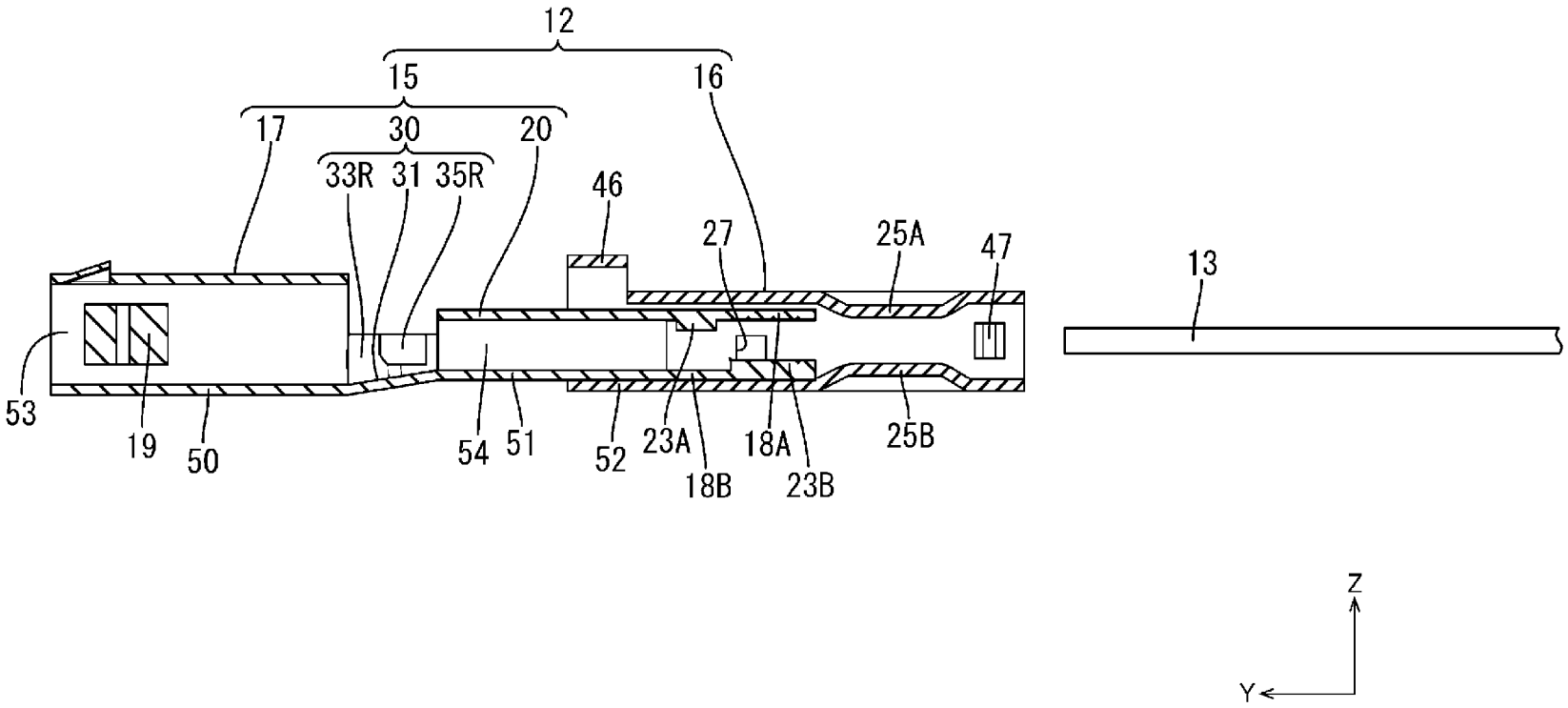
FIG. 6 is a section showing a terminal in a state where a slide portion is partially locked to the terminal body, and a wire.

As shown in FIG. 6, the slide portion 16 is in the form of a rectangular tube extending in the front-rear direction. The slide portion 16 is formed by a known method such as cutting, casting or press-working if necessary. An arbitrary metal such as copper, copper alloy, aluminum, aluminum alloy or stainless steel can be appropriately selected as a metal constituting the slide portion 16 if necessary. Although not particularly limited, the slide portion 16 according to this embodiment is made of stainless steel. A plating layer may be formed on the surface of the slide portion 16. An arbitrary metal such as tin, nickel or silver can be appropriately selected as a metal constituting the plating layer if necessary.

A cross-section of the inner surface shape of the slide portion 16 is the same as or somewhat larger than that of the outer shape of a region of the terminal body 15 where the upper and lower sandwiching portions 18A, 18B are provided. In this way, the slide portion 16 is disposed outside the region of the terminal body 15 where the upper and lower sandwiching portions 18A, 18B are provided.

As shown in FIG. 5, an upper pressurizing portion 25A (an example of a pressurizing portion) projecting downward is provided on the lower surface of the upper wall of the slide portion 16. A lower pressurizing portion 25B (an example of the pressurizing portion) projecting upward is provided on the upper surface of the lower wall of the slide portion 16.

As shown in FIG. 1, the partial lock receiving portion 26 is open at a position near a front end part in the side wall of the slide portion 16. Further, the full lock receiving portion 27 is open at a position behind the partial lock receiving portion 26 in the side wall of the slide portion 16. The partial lock receiving portion 26 and the full lock receiving portion 27 are resiliently lockable to the locking projection 28 provided on the side wall of the terminal body 15.

With the locking projections 28 of the terminal body 15 and the partial lock receiving portions 26 of the slide portion 16 locked, the slide portion 16 is held at the partial locking position with respect to the terminal body 15 (see FIG. 6). In this state, the upper and lower pressurizing portions 25A, 25B of the slide portion 16 are separated rearward from the rear end edges of the upper and lower sandwiching portions 18A, 18B of the terminal body 15. Further, in this state, an interval between the upper and lower sandwiching portions 18A, 18B is set to be larger than the diameter of the core 13 (see FIG. 7).

Figure 8:
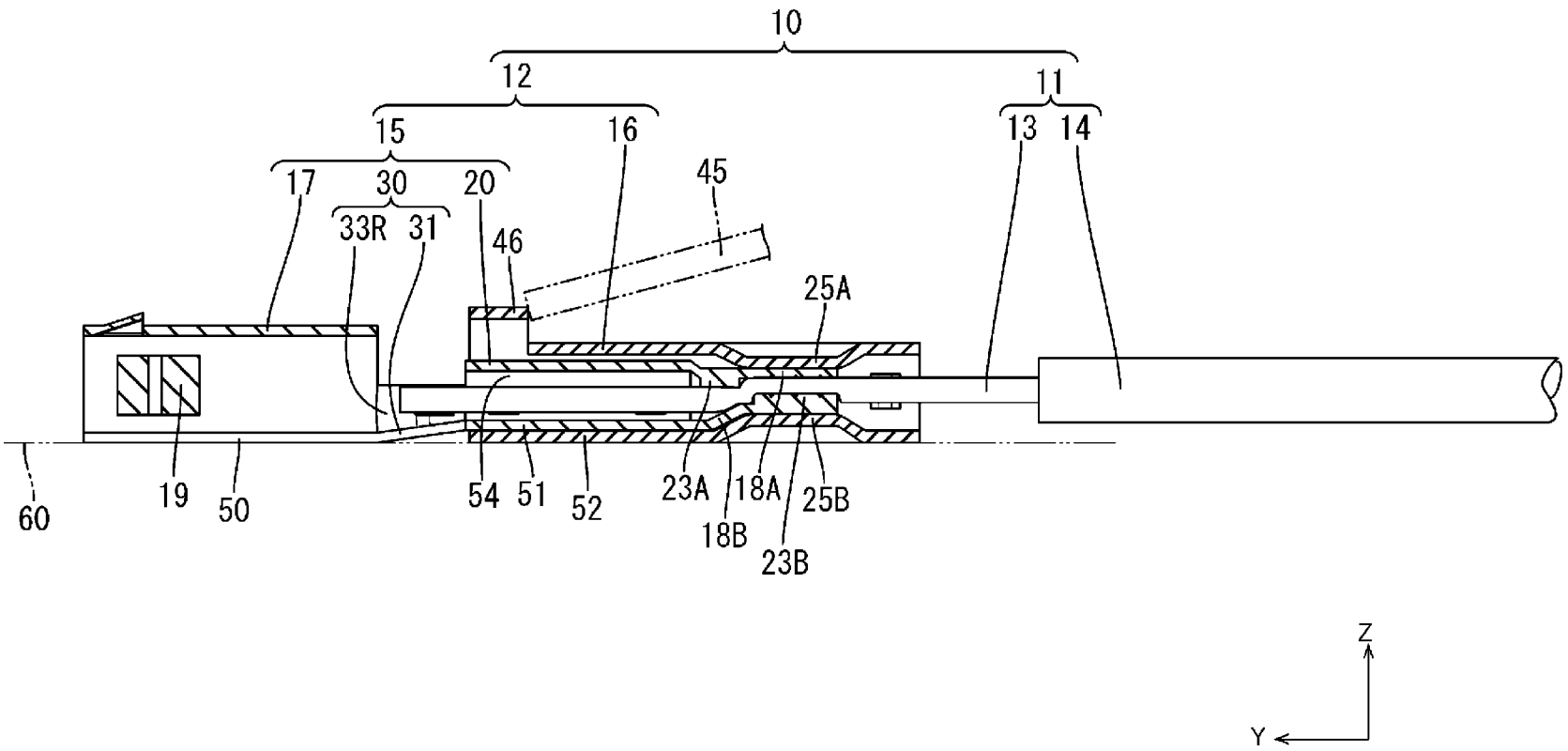
FIG. 8 is a section showing a state where the terminal body is fully locked to the slide portion.

As shown in FIG. 8, with the locking projections 28 of the terminal body 15 and the full lock receiving portions 27 of the slide portion 16 locked, the slide portion 16 is held at the full locking position with respect to the terminal body 15. In this state, the upper pressurizing portion 25A of the slide portion 16 is in contact with the upper sandwiching portion 18A from above the upper sandwiching portion 18A. Further, the lower pressurizing portion 25B of the slide portion 16 is in contact with the lower sandwiching portion 18B from below the lower sandwiching portion 18B.

As described above, the slide portion 16 is slidable between the partial locking position and the full locking position described above while being externally fit to the region of the terminal body 15 where the upper and lower sandwiching portions 18A, 18B are provided.

As shown in FIG. 8, with the slide portion 16 held at the full locking position with respect to the terminal body 15, the upper pressurizing portion 25A presses the upper sandwiching portion 18A from above, thereby deforming the upper sandwiching portion 18A downward. Further, the lower pressurizing portion 25B presses the lower sandwiching portion 18B from below, thereby deforming the lower sandwiching portion 18B upward. In this way, with the core 13 extending in the front-rear direction (extending direction) in a space between the upper and lower sandwiching portions 18A, 18B and the slide portion 16 held at the full locking position with respect to the terminal body 15, the core 13 is vertically sandwiched by the resiliently deformed upper and lower sandwiching portions 18A, 18B. That is, the upper sandwiching portion 18A contacts the core 13 from above by being pressed downward by the upper pressurizing portion 25A, and the lower sandwiching portion 18B contacts the core 13 from below by being pressed upward by the lower pressurizing portion 25B.

As shown in FIG. 8, with the slide portion 16 held at the full locking position with respect to the terminal body 15, the upper holding protrusion 23A of the upper sandwiching portion 18A presses the core 13 from above and the lower holding protrusion 23B of the lower sandwiching portion 18B presses the core 13 from below. In this way, the core 13 is pressed from above by the upper holding protrusion 23A and pressed from below by the lower holding protrusion 23B disposed at the position shifted in the front-rear direction from the upper holding protrusion 23A, thereby being held in a state bent in the vertical direction (an example of a direction intersecting the extending direction). The core 13 and the terminal 12 are electrically connected also by the upper and lower holding protrusions 23A, 23B.

As shown in FIG. 8, a jig contact portion 46 projecting upward from the upper wall is provided in a front end part of the slide portion 16. By bringing a jig 45 into contact with the jig contact portion 46 from behind and pushing the slide portion 16 forward by this jig 45, the slide portion 16 is movable forward.

As shown in FIG. 6, a pair of guiding portions 47 projecting inwardly of the slide portion 16 are provided at positions near a rear end part of the slide portion 16 on both left and right side walls. The guiding portions 47 are formed to become narrower from the rear side toward the front side. The core 13 slides in contact with the inner surfaces of the guiding portions 47, thereby being guided into the slide portion 16.

As shown in FIG. 8, with the slide portion 16 held at the full locking position with respect to the terminal body 15, the lower surface of the mating bottom wall 50 of the tube portion 17 and the lower surface of the bottom wall 52 of the slide portion 16 are located on the same plane 60.

[Connection Process of Wire 11 and Terminal 12]

Next, an example of a connection process of the wire 11 and the terminal 12 is described. The connection process of the wire 11 and the terminal 12 is not limited to the one described below.

The terminal body 15 and the slide portion 16 are formed by a known method. The slide portion 16 is assembled with the terminal body 15 from behind. The front end edge of the slide portion 16 comes into contact with the locking projections 28 of the terminal body 15 from behind and the side walls of the slide portion 16 are expanded and deformed. If the slide portion 16 is further pushed forward, the side walls of the slide portion 16 are restored and the partial lock receiving portions 26 of the slide portion 16 are locked to the locking projections 28 of the terminal body 15. In this way, the slide portion 16 is held at the partial locking position with respect to the terminal body 15 (see FIG. 6). In this way, the terminal 12 is obtained.

The core 13 of the wire 11 is exposed by stripping the insulation coating 14 by a known method.

If the wire 11 is further pushed forward, a front end part of the core 13 is introduced into the slide portion 16 from the rear end part of the slide portion 16. By the contact of the core 13 with the guiding portions 47 of the slide portion 16, the core 13 is guided into the slide portion 16. If the wire 11 is further pushed forward, the front end part of the core 13 enters the terminal body 15 and reaches the space between the upper and lower sandwiching portions 18A, 18B.

Figure 7:
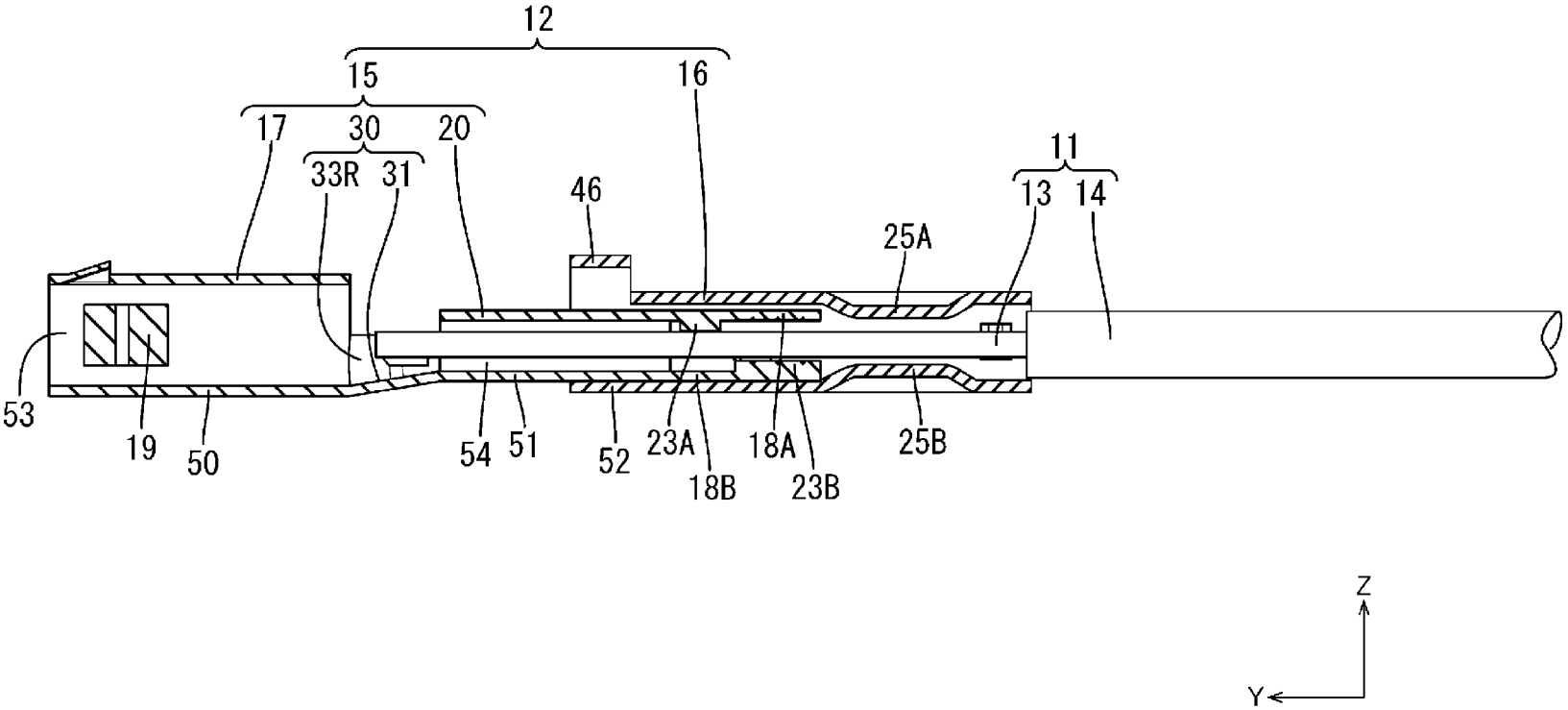
FIG. 7 is a section showing a state where the wire is inserted in the terminal in the state where the slide portion is partially locked to the terminal body.

As shown in FIG. 7, the interval between the upper and lower sandwiching portions 18A, 18B is set to be larger than an outer diameter of the core 13 with the slide portion 16 held at the partial locking position with respect to the terminal body 15.

As shown in FIG. 5, when the front end part of the core 13 reaches the coupling portion 30, the core 13 is inserted into a clearance between the right and left side walls 33R, 33L of the coupling portion 30. The outline of the right side wall 33R when the right recess 35R is not provided in the inner surface of the right side wall 33R and the outline of the left side wall 33L when the left recess 35L is not provided in the inner surface of the left side wall 33L are shown by two-dot chain lines in FIG. 5. A lateral width between the right and left recesses 35R, 35L is smaller than the diameter of the core 13 if the right and left recesses 35R, 35L are not respectively provided in the right and left side walls 33R, 33L. Thus, when the core 13 is inserted into the clearance between the right and left side walls 33R, 33L, the core 13 may be caught in the clearance between the right and left side walls 33R, 33L.

Since the right and left side walls 33R, 33L are respectively provided with the right and left recesses 35R, 35L in this embodiment, the core 13 is reliably inserted into the clearance between the right and left side walls 33R, 33L.

Subsequently, as shown in FIG. 8, the slide portion 16 is slid forward by bringing the jig 45 into contact with the jig contact portion 46 from behind. The slide portion 16 is relatively moved forward with respect to the terminal body 15. At this time, locking between the locking projections 28 of the terminal body 15 and the partial lock receiving portions 26 of the slide portion 16 is released and the side walls of the slide portion 16 ride on the locking projections 28 to be expanded and deformed.

When the slide portion 16 is moved forward, the side walls of the slide portion 16 are restored and the locking projections 28 of the terminal body 15 and the full lock receiving portions 27 of the slide portion 16 are resiliently locked. In this way, the slide portion 16 is held at the full locking position with respect to the terminal body 15.

With the slide portion 16 held at the full locking position with respect to the terminal body 15, the upper pressurizing portion 25A of the slide portion 16 comes into contact with the upper sandwiching portion 18A of the terminal body 15 from above to press the upper sandwiching portion 18A downward. Further, the lower pressurizing portion 25B of the slide portion 16 comes into contact with the lower sandwiching portion 18B of the terminal body 15 from below to press the lower sandwiching portion 18B upward. In this way, the core 13 is sandwiched from upper and lower sides by the upper and lower sandwiching portions 18A, 18B.

As shown in FIG. 8, the core 13 is sandwiched by the lower surface of the upper sandwiching portion 18A and the upper surface of the lower sandwiching portion 18B, whereby the oxide film formed on the surface of the core 13 is peeled off to expose the metal surface constituting the core 13. By the contact of this metal surface with the upper and lower sandwiching portions 18A, 18B, the wire 11 and the terminal 12 are electrically connected.

With the core 13 sandwiched from upper and lower sides by the upper and lower sandwiching portions 18A, 18B, the core 13 is sandwiched by the upper holding protrusion 23A of the upper sandwiching portion 18A and the lower holding protrusion 23B of the lower sandwiching portion 18B, thereby being held in the state extending in the front-rear direction and bent in the vertical direction. Since the core 13 can be firmly held in this way, a holding force of the wire 11 and the terminal 12 can be enhanced when a pulling force is applied to the wire 11. In this way, the wire with terminal 10 is completed.

[Functions and Effects of Embodiment]

Next, functions and effects of this embodiment are described. The terminal 12 according to this embodiment includes the terminal body 15 having the tube portion 17 to be connected to the mating terminal, the wire connecting portion 20 to be connected to the wire 11 and the coupling portion 30 for coupling the tube portion 17 and the wire connecting portion 20, and the slide portion 16 to be externally fit to the wire connecting portion 20, the wire connecting portion 20 includes the upper and lower sandwiching portions 18A, 18B extending in the front-rear direction and configured to sandwich the wire 11, the slide portion 16 includes the upper and lower pressurizing portions 25A, 25B for pressurizing the upper and lower sandwiching portions 18A, 18B toward the wire 11, the tube portion 17 includes the mating bottom wall 50 and the mating side walls 53 formed to rise upward from the mating bottom wall 50, the wire connecting portion 20 includes the wire-side bottom wall 51 and the wire-side side walls 54 rising upward from the wire-side bottom wall 51, and the coupling portion 30 is inclined downward from the wire-side bottom wall 51 toward the mating bottom wall 50 to couple the wire-side bottom wall 51 and the mating bottom wall 50.

Further, the wire with terminal 10 according to this embodiment includes the above terminal 12 and the wire 11 connected to the terminal 12.

Since the slide portion 16 is externally fit to the wire connecting portion 20, the slide portion 16 covers the wire-side bottom wall 51 from outside. Thus, the bottom wall 52 of the slide portion 16 projects more outward than the wire-side bottom wall 51. However, the tube portion 17 coupled to the wire-side bottom wall 51 by the coupling portion 30 projects more outward than the wire-side bottom wall 51 since the coupling portion 30 is inclined. In this way, both the bottom wall 52 of the slide portion 16 and the mating bottom wall 50 project outward with respect to the wire-side bottom wall 51, wherefore the step of the terminal 12 can be reduced as compared to the shape of the terminal 12 in which only the bottom wall 52 of the slide portion 16 projects.

Further, according to this embodiment, the coupling portion 30 includes the coupling bottom wall 31 coupling the mating bottom wall 50 and the wire-side bottom wall 51 and the right and left side walls 33R, 33L rising from the coupling bottom wall 31, and the right and left side walls 33R, 33L respectively include the constricted portions 34L, 34R bent in the directions toward each other.

If the coupling bottom wall 31 of the coupling portion 30 is inclined, the right and left side walls 33R, 33L are also bent. At this time, by providing the right and left side walls 33R, 33L respectively with the right and left constricted portions 34R, 34L bent in the directions toward each other, the terminal 12 can be reduced in size as compared to the case where the right and left side walls 33R, 33L are bent in directions away from each other.

According to this embodiment, the right and left recesses 35R, 35L are respectively provided in the inner surfaces of the right and left constricted portions 34R, 34L provided in the right and left side walls 33R, 33L.

To reliably connect the core 13 of the wire 11 and the wire connecting portion 20, the core 13 inserted through the wire connecting portion 20 is preferably inserted into the coupling portion 30 beyond the wire connecting portion 20. Since the right and left recesses 35R, 35L are formed in the respective inner surfaces of the right and left side walls 33R, 33L of the coupling portion 30, the interference of the inner surfaces of the right and left side walls 33R, 33L and the core 13 can be suppressed. As a result, when the core 13 of the wire 11 is inserted into the terminal 12, the buckling of the wire 11 or core 13 can be suppressed.

According to this embodiment, the bottom surface of the slide portion 16 and that of the tube portion 17 are disposed on the same plane.

Since the bottom surface of the slide portion 16 and that of the tube portion 17 are disposed on the same plane, the lower surface of the tube portion 17 and that of the slide portion 16 are disposed on the same plane 60. In this way, when the terminal 12 is accommodated into an unillustrated connector, the lower surface of the tube portion 17 and that of the slide portion 16 can be placed on a plane formed to place the terminal 12 in the connector without being inclined. In this way, troubles such as the rattling of the terminal 12 in the connector can be reliably suppressed.

According to this embodiment, the slide portion 16 is disposed slidably along the front-rear direction with respect to the wire connecting portion 20.

By a simple operation of sliding the slide portion 16 along the front-rear direction, the wire 11 and the terminal 12 can be electrically connected. In this way, the efficiency of a connecting operation of the wire 11 and the terminal 12 can be improved.

<Other Embodiments>

(1) Although the coupling bottom wall 31 is inclined as a whole in this embodiment, the coupling bottom wall 31 may be partially inclined.

(2) Although the terminal according to this embodiment is a so-called female terminal, it may be a male terminal.

(3) Although the right and left recesses 35R, 35L are provided in this embodiment, there is no limitation to this and either one of the right and left recess 35R, 35L may be provided. Further, both the right and left recesses 35R, 35L may be omitted.

(4) The terminal 12 may include one, three or more sandwiching portions.

(5) The bottom surface of the tube portion 17 and that of the slide portion 16 may not be disposed on the same plane.

(6) The mating side walls 53 may not rise upward from the side edges of the mating bottom wall 50. Further, the wire-side side walls 54 may not rise upward from the side edges of the wire-side bottom wall 51. Further, the left and right side walls 33L, 33R may not rise upward from the side edges of the coupling bottom wall 31.

LIST OF REFERENCE NUMERALS

10: wire with terminal
11: wire
12: terminal
13: core
14: insulation coating
15: terminal body
16: slide portion
17: tube portion (example of mating connecting portion)
18A: upper sandwiching portion (example of sandwiching portion)
18B: lower sandwiching portion (example of sandwiching portion)
19: resilient contact piece
20: wire connecting portion
23A: upper holding protrusion
23B: lower holding protrusion
25A: upper pressurizing portion (example of pressurizing portion)
25B: lower pressurizing portion (example of pressurizing portion)
26: partial lock receiving portion
27: full lock receiving portion
28: locking projection
30: coupling portion
31: coupling bottom wall
33L: left side wall (example of coupling side wall)
33R: right side wall (example of coupling side wall)
34L: left constricted portion (example of constricted portion)
34R: right constricted portion (example of constricted portion)
35L: left recess (example of recess)
35R: right recess (example of recess)
45: jig
46: jig contact portion
47: guiding portion
50: mating bottom wall
51: wire-side bottom wall
52: bottom wall of slide portion
53: mating side wall
54: wire-side side wall
60: plane

What is claimed is:

1. A terminal, comprising:

a terminal body including a mating connecting portion to be connected to a mating terminal, a wire connecting portion to be connected to a wire and a coupling portion for coupling the mating connecting portion and the wire connecting portion; and a shell to be externally fit to the wire connecting portion, wherein:

the wire connecting portion includes a sandwiching portion extending in an extending direction of the wire, the sandwiching portion sandwiching the wire, the shell includes a pressurizing portion for pressurizing the sandwiching portion toward the wire, the mating connecting portion includes a mating bottom wall and a mating side wall formed to rise upward in a predetermined rising direction from the mating bottom wall, the wire connecting portion includes a wire-side bottom wall and a wire-side side wall rising upward in the rising direction from the wire-side bottom wall, and the coupling portion is inclined in a direction opposite to the rising direction from the wire-side bottom wall toward the mating bottom wall to couple the wire-side bottom wall and the mating bottom wall.

2. The terminal of claim 1, wherein:

the coupling portion includes a coupling bottom wall coupling the mating bottom wall and the wire-side bottom wall and a pair of coupling side walls rising upward from the coupling bottom wall, and the pair of coupling side walls respectively include constricted portions bent in directions toward each other.

3. The terminal of claim 2, wherein a recess is provided in each of inner surfaces of the constricted portions provided in the pair of coupling side walls.

4. The terminal of claim 1, wherein a bottom surface of the shell and a bottom surface of the mating connecting portion are disposed on the same plane.

5. The terminal of claim 1, wherein the shell is disposed slidably along the extending direction of the wire with respect to the wire connecting portion.

6. A wire with terminal, comprising:

the terminal of claim 1; and a wire connected to the terminal.

* * * * *